US006371848B1

(12) United States Patent
Ashby

(10) Patent No.: US 6,371,848 B1
(45) Date of Patent: Apr. 16, 2002

(54) EDUCATIONAL GAME SIMULATING BUSINESS STARTUP TO INITIAL PUBLIC OFFERING

(76) Inventor: David C. Ashby, 815 Covingon Rd., Los Altos, CA (US) 94024

( * ) Notice: Subject to any disclaimer, the term of this patent is extended or adjusted under 35 U.S.C. 154(b) by 0 days.

(21) Appl. No.: 09/698,657

(22) Filed: Oct. 27, 2000

Related U.S. Application Data

(60) Provisional application No. 60/161,795, filed on Oct. 27, 1999.

(51) Int. Cl.[7] ..... A63F 9/24
(52) U.S. Cl. ..... 463/1; 273/256
(58) Field of Search ..... 463/1, 14, 30, 463/31; 273/256, 243, 284, 287, 236, 278, 461

(56) References Cited

U.S. PATENT DOCUMENTS 4,932,668 A * 6/1990 Stewart ..... 273/256
5,071,135 A * 12/1991 Campbell ..... 273/256
5,207,792 A * 5/1993 Anderson ..... 273/256
5,829,747 A * 11/1998 Nebel ..... 273/256
6,032,957 A * 3/2000 Kiyosaki et al. ..... 273/256
6,164,650 A * 12/2000 Wilkins et al. ..... 273/256

* cited by examiner

*Primary Examiner*—Joe H. Cheng
*Assistant Examiner*—Kim T. Nguyen
(74) *Attorney, Agent, or Firm*—David C. Ashby

(57) ABSTRACT

A game simulating business startup to initial public offering includes a board, business plans, playing pieces, cards and money. At the beginning of the game, the players fill out the beginning of a business plan. During the game, the players guide the business through four stages in order to form the business, build the management team, obtain funding, hire employees, locate office space, develop a product, market the product, hire lawyers and investment bankers, and deal with the securities and exchange commission. If successful, the company reaches IPO and the player calculates the net worth of the company. The board is square and divided into four stages. Each stage has a number of spaces and a respective goal to be accomplished during the stage, and each stage represents a point along a path from business startup to initial public offering. A numbers of playing pieces are provided and each player chooses a piece. The game is played by each player rolling dice and moving his playing piece from a start position on the board toward a finish position by way of the various stages. The game is not limited to a board and may also be played on a computer. A computer game embodiment of the invention can employ a multi-person game played over the internet, or can employ the computer as a record keeper or second player.

20 Claims, 5 Drawing Sheets

Business Plan

200

Company Name _____

Field of Business:

☐ Internet ☐ Retail

☐ Medical ☐ Sporting Goods

STAGE I

Management Team:

☐ CEO ☐ CFO ☐ CTO

STAGE II

Employees _____ (need 10)

Office Space _____ (need 10,000ft2)

STAGE III

Product Completed _____

FINANCES

| ROUND | Shares Sold | Shares Left 10M | Amount Raised |
|---|---|---|---|
| A ($1/share) | _____ | _____ | _____ |
| B ($2/share) | _____ | _____ | _____ |
| C ($4/share) | _____ | _____ | _____ |
| IPO ($10/share) | _____ | _____ | _____ |

Calculate Net Worth $_____

FIG. 2

EDUCATIONAL GAME SIMULATING BUSINESS STARTUP TO INITIAL PUBLIC OFFERING

REFERENCE TO RELATED APPLICATIONS

This application claims priority to Prov. No. 60/161,795 filed Oct. 27, 1999 and incorporated herein by reference.

FIELD

The invention is directed to an educational game for simulating business startup to initial public offering. In particular, the game provides both an educational experience and a competitive challenge among players while simulating a business startup to initial public offering.

BACKGROUND

Board games and computer software games can be both educational and fun. Conventional board games are for enjoyment although there are some games that are also educational. In the marketplace no known game exists that combines the educational opportunity and challenge of skill in taking a company from business startup to initial public offering.

What is needed is a game that overcomes the identified limitations and provides an educational game for simulating business startup to initial public offering.

SUMMARY

The invention is directed to an educational game for simulating business startup to initial public offering (IPO). In the exemplary embodiment, the game is played on a board and includes business plans, playing pieces, cards and money. At the beginning of the game, the players fill out the beginning of a business plan. During the game, the players guide the business through four stages in order to form the business, build the management team, obtain funding, hire employees, locate office space, develop a product, market the product, hire lawyers and investment bankers, and deal with the securities and exchange commission. If successful, the company reaches IPO and the player calculates the net worth of the company.

In the exemplary embodiment, the board is square and divided into four stages. Each stage has a number of spaces and a respective goal to be accomplished during the stage, and each stage represents a point along a path from business startup to initial public offering. A numbers of playing pieces are provided and each player chooses a piece. The game is played by each player rolling dice and moving his playing piece from a start position on the board toward a finish position by way of the various stages.

The game can be played a number of different ways. In one aspect of the invention, the first player to reach the IPO position wins the game. In another aspect of the invention, the first player to reach the IPO position is given a bonus for finishing first and the other players complete the game in the hope of having the greatest net worth at the end.

The game is not limited to a board and may also be played on a computer. A computer game embodiment of the invention can employ a multi-person game played over the internet, or can employ the computer as a record keeper or second player.

BRIEF DESCRIPTION OF THE FIGURES

Additional advantages of the invention will become apparent upon reading the following detailed description and upon reference to the drawings, in which:

FIG. 2 depicts a business plan according to an embodiment of the invention for use with the game board of FIG. 1;

DETAILED DESCRIPTION

The following detailed describes the invention with respect to exemplary configurations and rules. Those skilled in the art will recognize that there are alternate ways to play the game that are anticipated and contemplated by the description.

Figure 1:
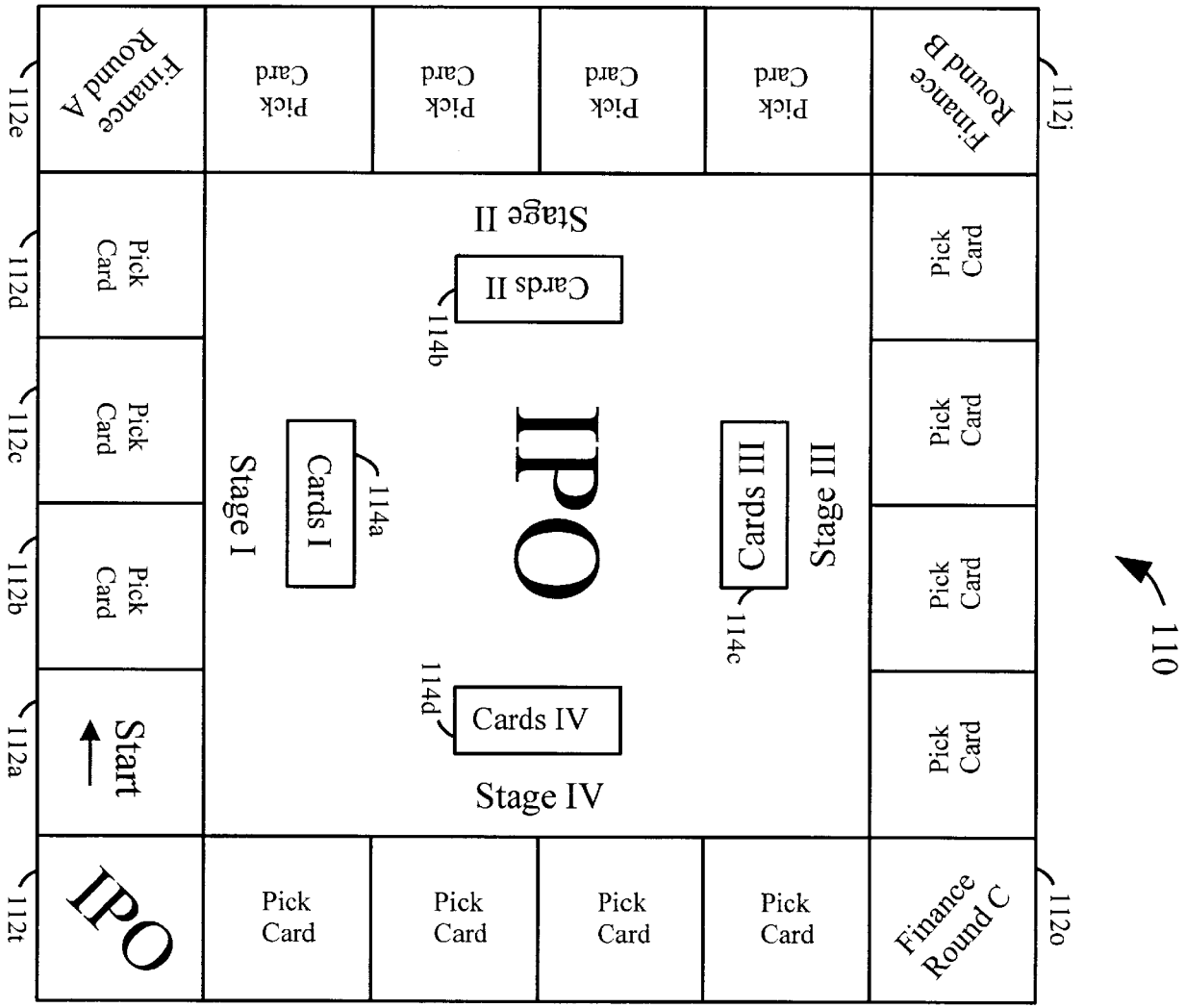
FIG. 1 depicts a game board according to an embodiment of the invention.

A game for simulating a business from startup to initial public offering (IPO) is described with reference to FIGS. 1–3. FIG. 1 depicts a game board 110 according to an embodiment of the invention. The board includes a number of spaces 112*a*–112*t* where the players move their pieces from the start position 112*a* to the IPO position 112*t*. FIG. 1 shows an exemplary number of spaces and any number of spaces, for example nine, can be used consistent with the size of the board. As shown in FIG. 1, the spaces 112*a*–112*t* are divided into a plurality of predetermined stages, Stage I, Stage II, Stage III and Stage IV, where each of the stages represents a point along a path from business startup 112*a* to IPO 112*t*. Stage I includes spaces 112*a*–112*d* and culminates at Finance Round A space 112*e*. Stage II includes spaces 112*f*–112*i* and culminates at Finance Round B space 112*j*. Stage III includes spaces 112*k*–112*n* and culminates at Finance Round C space 112*o*. Stage IV includes spaces 112*p*–112*s* and culminates at IPO space 112*t*.

Figure 3A:
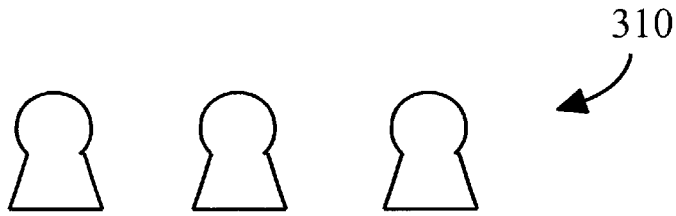
FIGS. 3A–B depict accessory game pieces and cards according to an embodiment of the invention.
Figure 3B:
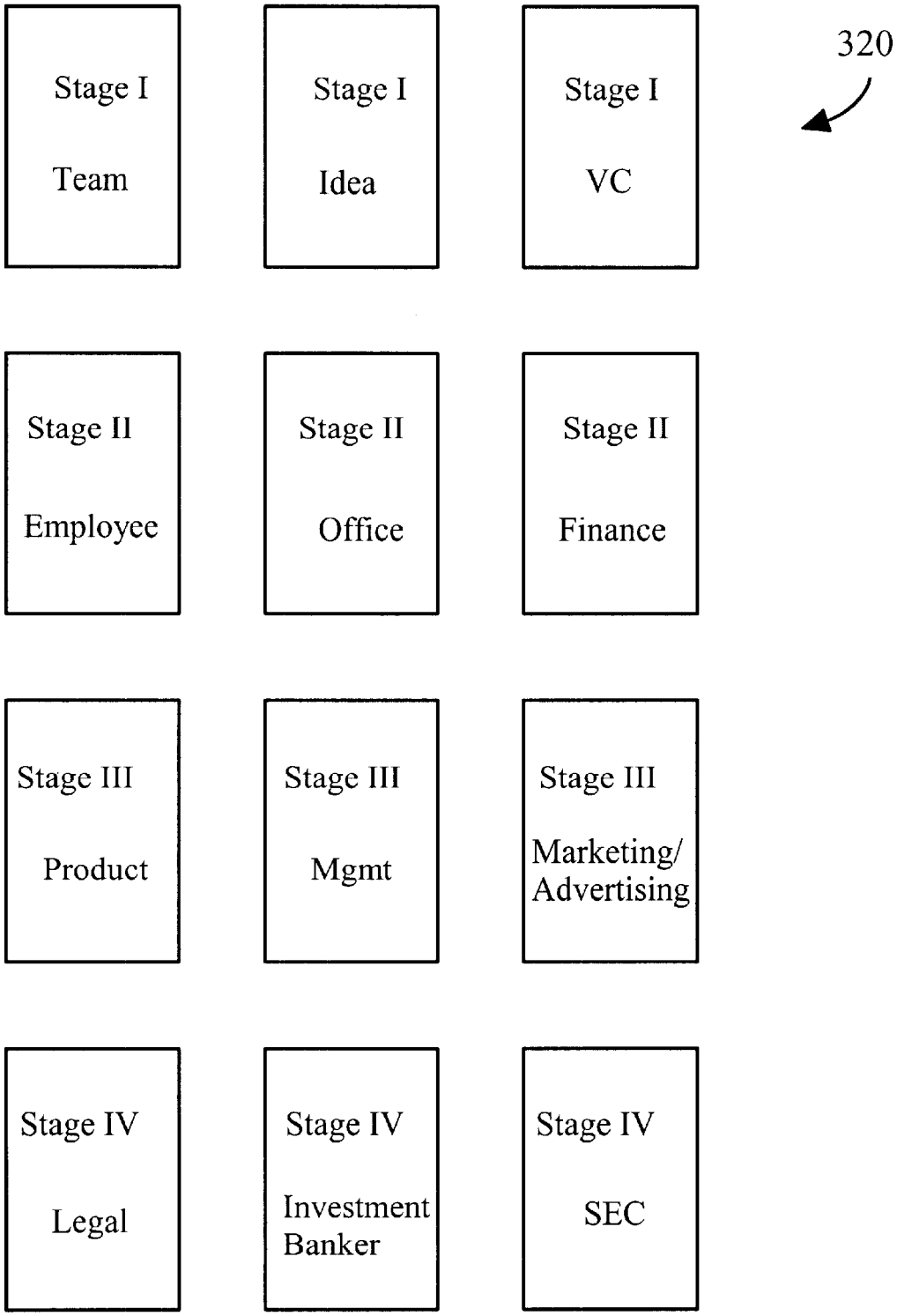

At the beginning of the game, the players each fill out a business plan 200 as shown in FIG. 2. The business plan identified the name of the startup, the idea, the area of technology, the type of stock of the company, the amount of stock and the asking price for the stock, and various finance parameters. The players are initially provided with a predetermined amount of seed capital, for example $500,000 and the company has an amount of stock, for example 10,000,000 shares. The player is given the money in the form of game money, but the player can also keep track of the business assets on the business plan 200 FIG. 3A show a plurality of playing pieces 310 that are provided with each piece associated with a player. These playing pieces can be in any form including those that represent the type of startup business that each player selects. The game is played by each player moving a playing piece from a start position on the board toward a finish position via the predetermined spaces. Along the way, the player must select cards 320 (FIG. 3B) that will help the player achieve the desired result in the stages.

The board also includes a number of locations 114*a*–114*d* for the cards 320 that are associated with each of the Stages and that provide instructions and results specific to that Stage. The players move along the spaces 112*a*–112*t* and select cards that assist in forming a startup business, financing the startup business, hiring employees, obtaining office space, developing a product for market, and in taking the business to initial public offering. As described above, the game is divided into four Stages and the players must reach certain milestones in each stage or at the culminating Finance Round. If a player does not meet a milestone during the Stage, the player can complete the milestone at the culminating Finance Round through the sale of stock and payment of money. For example, in Stage I, the players select the cards to develop their idea, build their team and pitch their idea to venture capitalists. The cards will provide results that depend on the idea and team, for example, that the idea is a good one and that they advance a predetermined number of spaces, or that the idea is a bad one and that they move back a predetermined number of spaces. The players may refine their idea and get positive or negative reviews from venture capitalists.

As shown in FIG. 2, during Stage I, the player must achieve a milestone such as securing a full management team for the company including a Chief Executive Officer (CEO), Chief Financial Officer (CFO) and Chief Technical Officer (CTO). Each player rolls the dice and advances that number of spaces toward Finance Round A. After advancing, the player draws a card that identifies an event such as the addition of a management team member, additional funding, etc. At the end of Stage I, the player stops at the space marked Finance Round A 112*e*. If the player does not have a full management team upon reaching Finance Round A, the player must hire the missing team members for an amount of money, for example $500,000 each. The player may use proceeds of the Finance Round A to pay for the hiring(s).

Finance Round A allows the player to sell stock for an amount of money, for example $1/share. This requires that the player apply a strategy as to how much the player believes the next stage will cost. It is advantageous to sell as few shares as necessary at this Finance Round and to preserve the shares for the higher valuations at later Finance Rounds.

During Stage II, the player must achieve a milestone such as securing 10 employees and 10,000 square feet of office space. Like in Stage I, each player rolls the dice and advances that number of spaces toward Finance Round B. After advancing, the player draws a card that identifies an event such as the option to hire employees or lease office space, etc. Other events that can transpire include increased salary demands by management team members and other problems. In one instance, one player can hire employees away from another player. The player stops at the space marked Finance Round B 112*j*. If the player does not have a full complement of employees and office space upon reaching Finance Round B, the player must hire the required employees for an amount of money, for example $100,000 each and lease the required office space for an amount of money, for example $100,000 per necessary 1,000 square feet. The player may use proceeds of the Finance Round B to pay for the hiring(s) and office space.

Finance Round B allows the player to sell stock for an amount of money, for example $2/share. This requires that the player apply a strategy as to how much the player believes the next stage will cost. It is advantageous to sell as few shares as necessary at this Finance Round and to preserve the shares for the higher valuations at later Finance Rounds.

During Stage III, the player must achieve a milestone such as developing a product for market including marketing and advertising. Like in the earlier Stages, each player rolls the dice and advances that number of spaces toward Finance Round C. After advancing, the player draws a card that identifies an event such as the option to develop the product for the identified cost, and to market and advertise the product. Other events that can transpire include marketing and advertising cost overruns as well as product delays and lawsuits. In one instance, one player can win a lawsuit against another player and collect damages. The player stops at the space marked Finance Round C 112*o*. If the player has not completed the product development upon reaching Finance Round C, the player must develop the product for an amount of money, for example $4,000,000. The player may use proceeds of the Finance Round C to pay for the product development.

Finance Round C allows the player to sell stock for an amount of money, for example $4/share. This requires that the player apply a strategy as to how much the player believes the next stage will cost. It is advantageous to sell as few shares as necessary at this Finance Round and to preserve the shares for the higher valuations at the IPO 112*t*.

During Stage IV, the player must achieve a milestone such as hiring lawyers to prepare an initial filing with the Securities and Exchange Commission (SEC), negotiate to sell the stock to investment bankers and deal with the SEC to go public. Like in the earlier Stages, each player rolls the dice and advances that number of spaces toward IPO. After advancing, the player draws a card that identifies an event such as hiring the lawyers, negotiating with the investment bankers or dealing with the SEC. Other events that can transpire include legal costs, investment banker demands and SEC regulations. When the player reaches the last space, the company goes public and all remaining shares are sold for an amount of money, for example $10/share.

In one embodiment, the first player to reach the finish position IPO 112*t* wins the game. In another embodiment, the player with the highest net worth wins the game. For example first player to reach IPO receives a bonus payment of $5,000,000, and the later players do not receive a bonus. Then the players calculate their respective net worth and the player with the highest net worth wins the game. This allows a second player who may apply better strategy, but not necessarily finish first, to win the game. Also, there can be graduated bonuses for players who finish in later positions for example second, third and so on.

Many additional variations of the rules are possible. A simple version can be played deciding on a predetermined amount of money each player receives at each Finance Round. For example, $2,000,000 at Finance Round A, $4,000,000 at Finance Round B, and $8,000,000 at Finance Round C. Another variation is by playing a number of consecutive games and keeping score by adding up the net worth of each player over a number of games.

Figure 4:
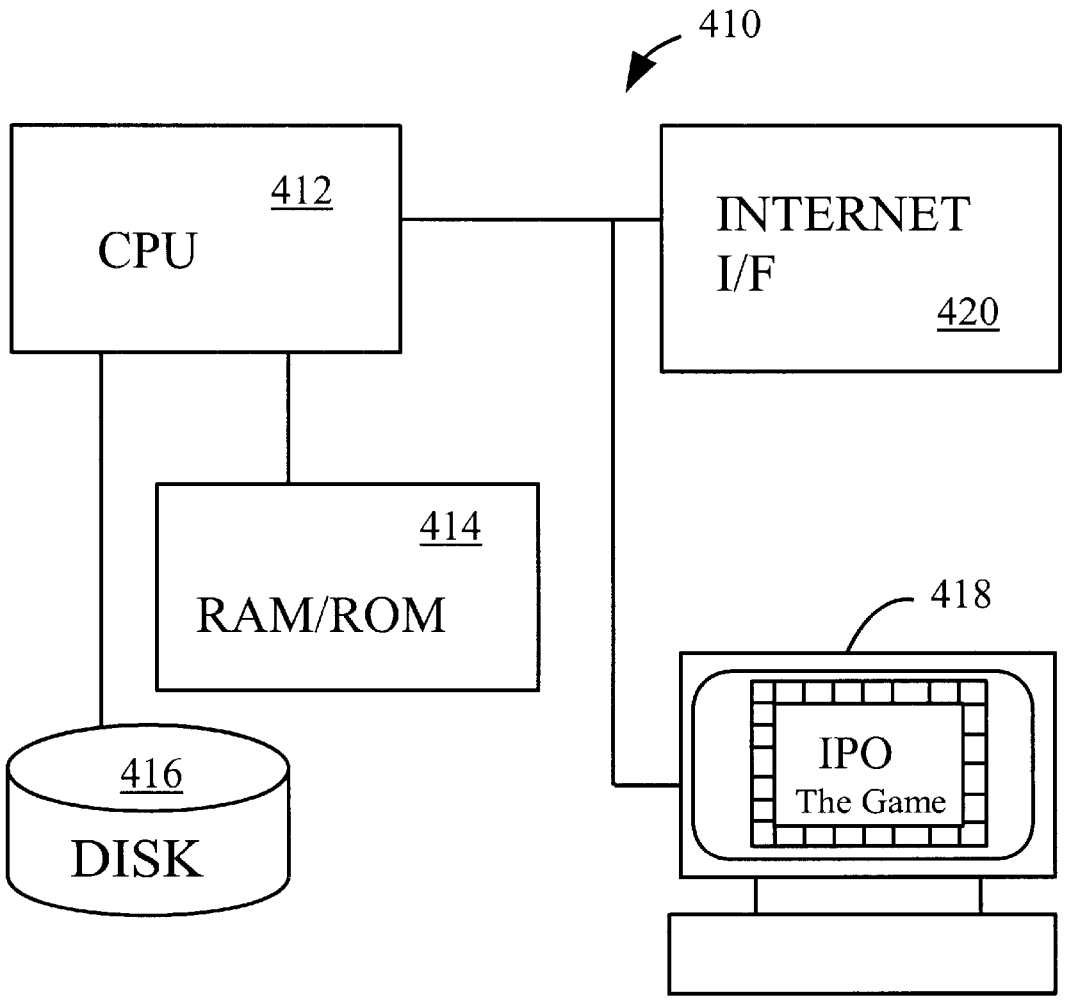
FIG. 4 depicts a computer running a game according to an embodiment of the invention.

FIG. 4 depicts a computer running a game according to an embodiment of the invention. The computer stores the game information in its memory and allows the player to make strategic decisions similar to those made in a physical board game. The player can play against the computer, against past games, and since the computer has access to the Internet, multiple players can play against one another over the Internet.

Figure 5:
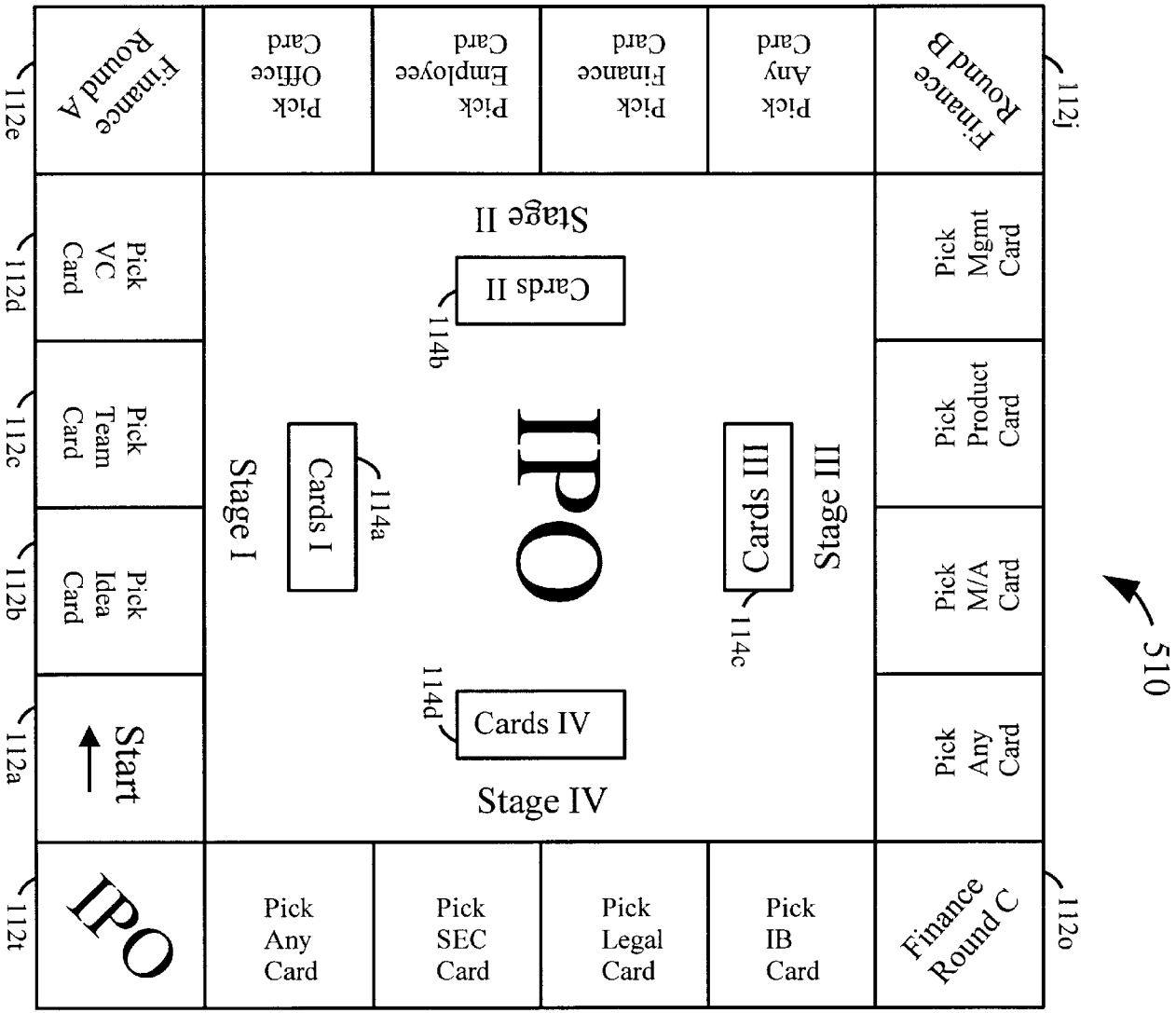
FIG. 5 depicts a game board according to an alternate embodiment of the invention.

FIG. 5 depicts a game board 510 according to an alternate embodiment of the invention. In this embodiment, the spaces in the Stages are dedicated to a specific type of card that the player picks for landing on that space. Of course, the number of spaces can be increased over the number shown in FIG. 5. For example, it is beneficial to have a number, for example, nine spaces for each stage so that the players will have the opportunity to land on a number of spaces associates with a specific card type.

Having disclosed exemplary embodiments and the best mode, modifications and variations may be made to the disclosed embodiments while remaining within the subject and spirit of the invention as defined by the following claims.

What is claimed is:

1. An educational game simulating business startup to initial public offering, comprising:

a board including a number of spaces, where the spaces are divided into a plurality of stages with a finance space between each stage, where each of the stages represents a portion of a path from business startup to initial public offering, where the finance spaces each represent a finance round where players may sell stock in their respective businesses to finance the play of the game and where the price of the stock for at least one player increases along the path from business startup to initial public offering;

a plurality of playing pieces, each piece associated with a player;

a business plan for each player representing their business and including portions to be completed by the player during the course of the game, where at least one of the portions corresponds to at least one stage of the game; and wherein the game is played by each player moving a playing piece from a start position on the board toward a finish position by way of the spaces.

2. The educational game of claim 1, wherein:

the spaces are positioned in a substantially contiguous path.

3. The educational game of claim 1, wherein:

the business plan includes a goal for at least one stage of the game and a location in each portion associated with a stage of the game to indicate that the player has completed the goal set forth in the respective stage.

4. The educational game of claim 2, wherein:

the business plan includes a goal for at least one stage of the game and a location in each portion associated with a stage of the game to indicate that the player has completed the goal set forth in the respective stage.

5. The educational game of claim 1, further comprising:

at least one set of cards corresponding to at least one stage of the game.

6. The educational game of claim 3, further comprising:

at least one set of cards corresponding to at least one stage of the game.

7. The educational game of claim 1, wherein:

the business plan for each player includes portions to be completed by the player during the course of the game, where each stage of the game corresponds to a portion and where each such portion includes a location to indicate that the player has completed a goal set forth in the respective stage.

8. The educational game of claim 5, wherein:

the business plan for each player includes portions to be completed by the player during the course of the game, where each stage of the game corresponds to a portion and where each such portion includes a location to indicate that the player has completed the goal set forth in the respective stage.

9. The educational game of claim 1, wherein:

the first player to reach the finish position wins the game.

10. The educational game of claim 1, wherein:

the player who finishes with the most money wins the game.

11. The educational game of claim 1, wherein:

the first player to reach the finish position is given a bonus and the player who finishes with the most money wins the game.

12. The educational game of claim 5, wherein:

the first player to reach the finish position is given a bonus and the player who finishes with the most money wins the game.

13. The educational game of claim 1, wherein:

the game is played on a computer.

14. An article of manufacture for playing an educational game simulating business startup to initial public offering on a computer, comprising:

a software structure, configurable for storage in a computer memory, including information relating to a board having a number of spaces, where the spaces are divided into a plurality of stages with a finance space between each stage, where each of the stages represents a portion of a path from business startup to initial public offering, where the finance spaces each represent a finance round where players may sell stock in their respective businesses to finance the play of the game and where the price of the stock for at least one player increases along the path from business startup to initial public offering;

wherein the software structure is configured to store information related to each player playing the game including information representing a playing piece of each player and the position of each playing piece on the board;

wherein the software structure is configured to store information related to a business plan for each player representing their business and including portions to be completed and stored by the computer during the course of the game in response to input by the player, where at least one of the portions corresponds to at least one stage of the game; and wherein the game is played by each player moving their playing piece from a start position on the board toward a finish position by way of the spaces.

15. The article of claim 14, wherein:

the software structure stores information related to the business plan including a goal for at least one stage of the game and a location in each portion associated with a stage of the game to indicate that the player has completed the goal set forth in the respective stage.

16. The article of claim 14, wherein:

the software structure includes information representing at least one set of cards corresponding to at least one stage of the game.

17. The article of claim 15, wherein:

the software structure includes information representing at least one set of cards corresponding to at least one stage of the game.

18. A method of playing an educational game simulating business startup to initial public offering on a board including a number of spaces, where the spaces are divided into a plurality of stages with a finance space between each stage, where each of the stages represents a portion of a path from business startup to initial public offering, where the finance spaces each represent a finance round where players may sell stock in their respective businesses to finance the play of the game and where the price of the stock for at least one player increases along the path from business startup to initial public offering, comprising the steps of:

partially completing a business plan representative of a business, where the business plan includes portions to be completed during the course of the game and where at least one of the portions corresponds to a stage of the game;

advancing a playing piece through a first stage of the game along the path;

further completing the business plan to record a goal achieved during the first stage of the game;

reaching a first finance space at the end of the first stage representing a first finance round;

selling stock in the business in exchange for cash at the first finance round;

advancing the playing piece through a second stage of the game along the path;

further completing the business plan to record a goal achieved during the second stage of the game;

reaching a second finance space at the end of the second stage representing a second finance round;

selling stock in the business in exchange for cash at the second finance round;

advancing the playing piece through a third stage of the game along the path;

further completing the business plan to record a goal achieved during the third stage of the game;

reaching a third finance space at the end of the third stage representing a third finance round;

selling stock in the business in exchange for cash at the third finance round;

advancing the playing piece through a fourth stage of the game along the path;

reaching an Initial Public Offering (IPO) space at the end of the fourth stage representing an IPO round;

selling stock in the business in exchange for cash at the IPO round; and calculating the net worth of the business.

19. The method of claim 18, further comprising the steps of:

drawing a card associated with the first stage while advancing the playing piece through the first stage of the game along the path;

drawing a card associated with the second stage while advancing the playing piece through the second stage of the game along the path; and drawing a card associated with the third stage while advancing the playing piece through the third stage of the game along the path.

20. The method of claim 18, wherein:

the steps are performed using a computer.

* * * * *